US010143879B1

(12) United States Patent
Thomas

(10) Patent No.: US 10,143,879 B1
(45) Date of Patent: Dec. 4, 2018

(54) PAIR OF SPOTTER ARMS FOR A WEIGHT BENCH

(71) Applicant: Rex Michael Thomas, Buena Park, CA (US)

(72) Inventor: Rex Michael Thomas, Buena Park, CA (US)

( * ) Notice: Subject to any disclaimer, the term of this patent is extended or adjusted under 35 U.S.C. 154(b) by 31 days.

(21) Appl. No.: 15/206,601

(22) Filed: Jul. 11, 2016

(51) Int. Cl.
*A63B 21/078* (2006.01)
*A63B 21/00* (2006.01)

(52) U.S. Cl.
CPC .... *A63B 21/0783* (2015.10); *A63B 21/00047* (2013.01); *A63B 21/078* (2013.01)

(58) Field of Classification Search
CPC ..... A63B 21/078; A63B 21/0783
See application file for complete search history.

(56) References Cited

U.S. PATENT DOCUMENTS 4,368,884 A * 1/1983 Colvin ..... A63B 21/4029 482/104
4,799,673 A * 1/1989 Selle ..... A63B 21/078 482/104
6,926,648 B2 * 8/2005 Capizzo ..... A63B 21/078 482/104
7,585,259 B2 * 9/2009 Turner ..... A63B 21/078 482/104
8,876,672 B2 * 11/2014 Schiano ..... A63B 21/078 482/104
9,717,943 B2 * 8/2017 Klonoski ..... A63B 21/078

* cited by examiner

*Primary Examiner* — Loan H Thanh
*Assistant Examiner* — Rae Fischer
(74) *Attorney, Agent, or Firm* — James F. Kirk

(57) ABSTRACT

A pair of spotter arms for use with a weight bench comprising a right and a left spotter arm having respective right and left spotter arm benches, each with a safety bar, a cross bar and a curl support bar, the safety bars, cross bars and a curl support bars each having a top surface forming a common plane, the spotter arms being coupled to a weight bench via two vertical supports captured by clamps extending from the curl support bars, and having six adjustable length legs for adjusting the height of the plane above the chest of a weight lifter on the weight bench, the spotter arm safety bars being positioned to interfere with an inadvertent and dangerous decent of a barbell bar, the safety bars being positioned to stop the decent of the barbell bar.

7 Claims, 10 Drawing Sheets

PAIR OF SPOTTER ARMS FOR A WEIGHT BENCH

This invention was not made with government funds or with a government funded effort. This application claims the benefit of priority the subject matter and Figures shown in Design patent application Ser. No. 29/525,809 filed May 4, 2015, the subject matter and Figures of which are incorporated herein by reference.

FIELD OF THE INVENTION

This invention relates to the field of weight equipment and more specifically to equipment used with a weight bench from which a participant positions himself to reach upward to grasp and lift a barbell, and as a convenience for a participant who elects to do a curl exercise and who wishes to avoid having to bend at the waist and reach for a curl barbell typically at shin height.

A weight bench is typically provided with a rigid frame that provides vertical support members at the right and left sides of the weight bench adjacent to the participant's ears. In this application, these vertical support members will be referred to as right and left goal posts with the right goal post being adjacent to the participant's right ear and the left goal post being adjacent to the participant's left ear as the participant lays on the bench. The frame and right and left goal posts permit unrestricted vertical motion of a barbell and its assembled weights or plates at opposing ends of the barbell. The left and right goal posts are typically equipped with hooks, yokes or saddle, that support a barbell transverse to, and above weightlifter, participant's head locating the barbell above and conveniently at arms length and transverse to the chest of the participant.

When exercising, the weight lifter raises the barbell off of the hooks or yokes and proceeds to lower the barbell in a vertical plane transverse to his body over a horizontal area which if projected downward to the participant would extend from his throat to his upper chest

BACKGROUND

The following background discussion includes information that may be useful in understanding the present invention. It is not an admission that any of the information provided herein is prior art or relevant to the presently claimed invention, or that any publication specifically or implicitly referenced is prior art.

In operation, a participant or weightlifter in a bench press exercise moves the barbell with a weight limit selected to be at a value at which the participant can, at most, perform ten repetitions, or at most, the weight that can be pressed or lifted once or twice. The repetition count selected is a goal that the participant elects to accept based on his or her training objectives. With each session, the participant attempts to add more repetitions or weight to the barbell for the purpose of gradually increasing the threshold at which a predetermined muscle group of the participant is unable to support a further increase in the value of the weights being used. When a participant inadvertently increases the weight of the plates on the barbell to a point at which a loss of control of the barbell occurs, the result is an unexpected decent of the barbell toward the participants chest, neck or face with only chance guiding the trajectory.

Pushing the limits in this type of training results in the most progressive improvement in the strength of the particular muscle group involved. Consequently, regular bench pressing will expose an over aggressive weight lifter to the possibility of episodes in which the weight lifter is struck with a barbell on the region extending from his throat to his upper chest when an attempt to increase performance failed. The possibility of harm is reduced if a spotter; usually another participant, intervenes and provides assistance by catching the falling barbell and stopping its uncontrolled decent.

However, history has shown that weight lifters sometimes participate without the benefit of a spotter, and partially minimize the risk associated with a falling barbell and its assembled weights by using an apparatus designed to eliminate the need for a "spotter", while at the same time, assisting the individual to reduce the possibility of injury or death following a loss of control.

In operation, a weightlifter in a bench press exercise, lifts the barbell with a selected weight limit, in witch the participant can perform his or her desired number of repetitions. Because of the Design of most weight benches, A human spotter is needed to assist the weightlifter in each and every repetition to insure that, if the weightlifter can not complete a repetition. The weightlifter is not pined crushed, injured or killed by the falling weights.

However history has shown that the danger of injury is present even with two or three human spotters hovering over the weightlifter for safety. Human reaction time is not always fast enough to stop the barbell from falling, crushing or killing the weightlifter. Use of a human spotter has been proven to be another unsafe way of protecting the weightlifter from serious or fatal injury.

Most people are unaware of this hazard, leaving a false sense of safety to the person performing a bench press using a human spotter. The need for a safer spotting method or protocol has led me to the development of the Pair of Spotter Arms innovation.

DESCRIPTION OF RELATED ART

An example of such an apparatus appears in U.S. Pat. No. 4,411,425 for a Bench Press Safety Rest to Milner that provides two adjustable bar supporting members attached symmetrically on each longer side of a weight bench seat section. The attached adjustable bar supporting members extend upwards in position with top mounted yokes for the purpose of catching and supporting a resting barbell immediately above the chest of the participant US Application 2004/0162200 by Brawner on Aug. 19, 2004 shows a Self Spotting Safety Bench Press composed of an adjustable bench and uprights located on either side of the bench adjacent the lifters upper body. arms extend from the uprights into the barbells pathway and have the ability to slide up and down to contact the barbell and decrease the weight exerted on the participant thereby allowing the participant to reduce the chance of loss of control.

U.S. Pat. No. 4,799,673 for a Bench Press Safety Apparatus shows a bench press safety apparatus including safety supports and weight unloading shelves. The shelves are laterally adjustable to permit alignment with weight discs on a barbell, with the barbell being supported on the safety supports. The unloading shelves support the barbell and weight discs after they have been relocated from the safety supports to the unloading shelves in order to unload and support the barbell.

US Application US 2007/0072750 A1 was filed on Sep. 26, 2005 by Andrews for a Weight Spotting Device shows a portable self spotting weight safety apparatus comprising uprights positioned on either side of a weight bench and herein referred to as goal posts. Barbell support arms extending from the uprights and into the pathway of the barbell. Rotating screws located in the uprights raise and lower the support arms to a position selected to stop an out of control event in which the barbell is falling toward the weight lifter.

Finally, U.S. Pat. No. 4,205,838 to McIntosh for an Adjustable Safety Stands for a Barbell shows a pair of stands for catching the barbell weight plates while the barbell bar is above the chest of the weight lifter. The stands each have a height adjustment to permit them to catch the plates at the end of the barbell or if raised to the height of the bar, to catch the bar. The adjustable weight stands must be aligned with the weights as they fall to permit the stands to intervene and protect the participant weight lifter.

Prior structures of this type have utilized fixed stands for holding the barbell before and after the lift. See for example U.S. Pat. No. 3,118,668, U.S. Pat. No. 3,342,485 and U.S. Pat. No. 3,625,511. Each of these three references will now be briefly mentioned.

In U.S. Pat. No. 3,118,668 a barbell exercising device is disclosed having a fixed frame wherein the barbell is supported by a bar on the stationary frame and its limits of vertical travel are restricted. Catch stands for the plates of a barbell are disclosed positioned below the normal vertical travel path of the barbell and the plates thereon.

In U.S. Pat. No. 3,342,485 an exercising bench is shown having elevated barbell support stands on either side thereof well above the normal vertical travel path of the barbell. In the present invention pair of spotter arms, the spotter arms provide parallel safety bars positioned well below the desirable travel path of the barbell and plates permitting unrestricted free movement thereof.

In U.S. Pat. No. 3,625,511 a multi-purpose exercising bench is disclosed having fixed barbell supports arranged substantially in the normal barbell travel path.

The present invention discloses movable and adjustable safety stands for use with an weight bench that in no way interferes with the vertical or horizontal travel path of the barbell or plates thereon, but will catch the barbell bar if the barbell is dropped and thereby prevent injury to persons using the claimed pair of spotter arms apparatus with the invention comprising a Left Spotter arm and a Right Spotter Arm.

The above references fail to show an apparatus that will accommodate a falling barbell situation in which one side of the bar starts to fall on one side, and while the bar obtains a tilt and descends on one side, the barbell develops a rotational velocity and follows a helical path. In such an event, the rotation of the bar begins to partially align the bar with the longitudinal axis of the weight bench. A situation such as this can be anticipated in response to the participant having a single weekend arm that fatigues and suddenly yields under the barbell load. Each of the machines taught provide a target region into which the barbell and end weight plates hopefully must move in response to the development of an out-of-control situation. The fall of the barbell is therefore dependent on an element of chance along with the possibility of grave or fatal injury if luck is not with the participant.

Prior to these early innovations, the only alternatives to the presence of a human spotter, as a safety measure in weight bench design was the attachment of two hooks approximately located one foot above the weight bench seat, one attached to each of the goal posts or main vertical supports at the head of the bench. This supposedly enables a fatigued person doing a bench press exercise to, with what partial arm extension he can muster, pass the now too heavy barbell over his throat and face and onto the hooks, in a last ditch effort to abandon the weight. This is hazardous, especially when attempting a single maximum effort of one repetition with a maximum weight.

Thus, there remains a need for a system and method that offers added protection for the weightlifter who is exercising at or near his limit of capability and who is at risk without the protection of a human spotter.

SUMMARY OF THE INVENTION

A pair of spotter arms provides a left and a right spotter arm. Each spotter arm is clamped to a respective goal post which in turn is rigidly coupled to the end of a weight bench, closest to the head of a weightlifter or participant. The spotter arms shown allow for protection of the weightlifter in the event of an inadvertent fall of the barbell. The spotter arms function if the barbell bar is longer than the distance between the safety bars on the respective right and left spotter arms. FIG. 1 shows a barbell in which the distance between the safety bars allows the weight plates to be within the space between left and right safety bars provided by the spotter arms.

The spotter arms provide a pair of curl support bars which function to eliminate the need for the weightlifter to bend over, and stress his back before raising a curling bar bell to waist height, before beginning to perform a curl exercise. The curl exercise barbell is returned to the curl support bars at the conclusion of the weightlifters repetitions instead of returning the curl exercise barbell to the floor.

It is a first object of this invention is to provide a simple mechanical substitute for a spotter, thereby allowing an individual to do the bench press alone with relatively greater safety and convenience.

A second object of the invention is that the device should serve as an easily installed accessory to, or integrated component of most weight benches.

A further object of the invention is that it should be easily adjustable to accommodate the range of older adolescent and adult sized persons who may use the invention pair of spotter arms. The ability to adjust the vertical position of a safety plane established by the top surfaces of the safety bar, the cross bar and the curl support bar above the face, neck and chest of the weightlifter, is critical to the bench press safety rest method.

DETAILED DESCRIPTION

The inventive subject matter in this description provides apparatus, systems, and methods written to support the claimed invention.

Figure 1:
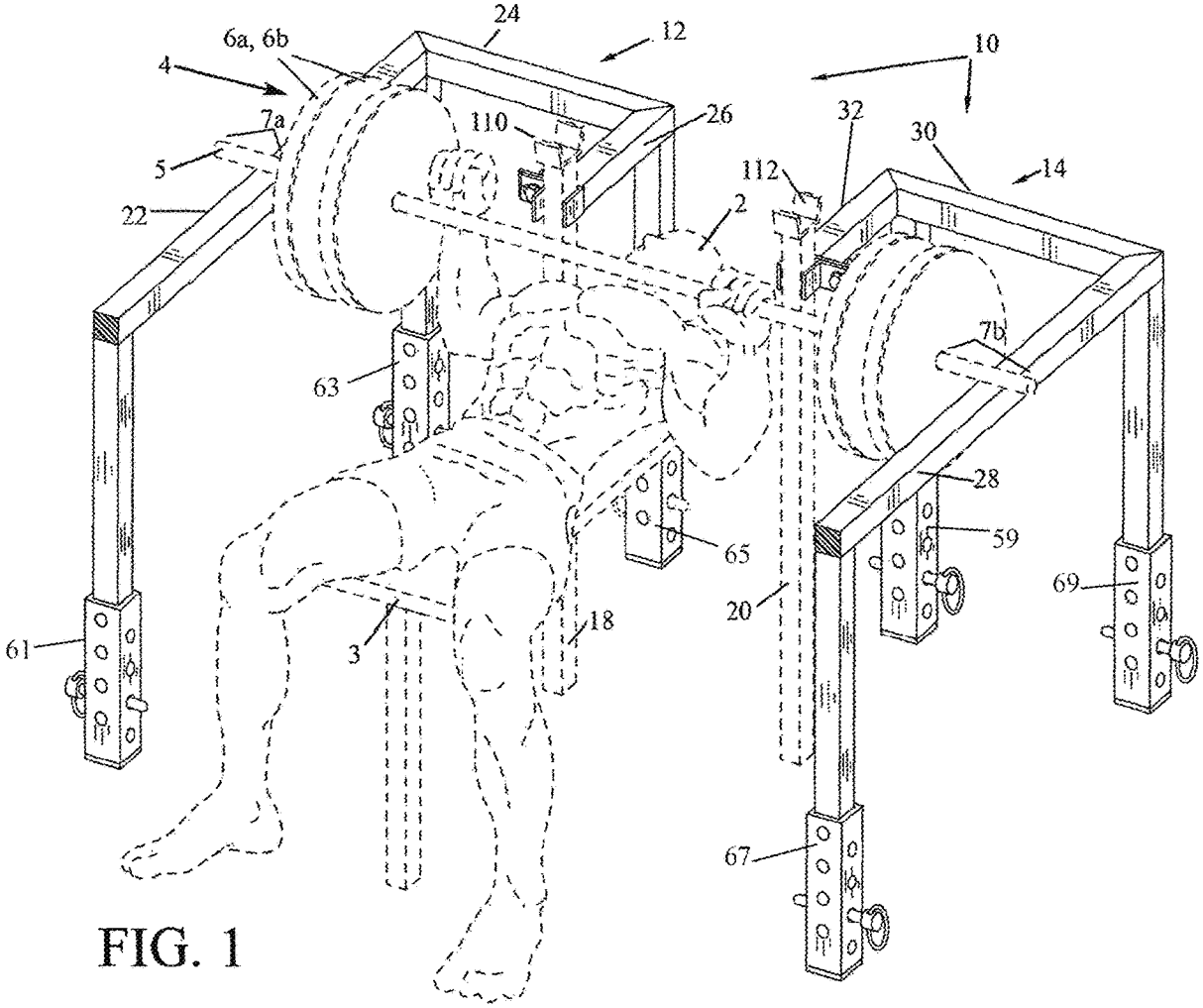
FIG. 1 is a schematic left side, from the weightlifter viewpoint, front perspective view of a pair of spotter arms coupled to a weight bench that is shown protecting a weight lifter's neck from a fallen barbell, the weightlifter and weight bench being shown in broken lines.

FIG. 1 shows a weightlifter 2 on a laying on a weight bench 3 in distress a moment after the weightlifter 2 has lost control. A barbell 4 has fallen, and a barbell bar 5 is across the neck of the weightlifter 2. The barbell is shown with equal numbers of weight plates 6*a*, 6*b*, on the right and on the left sides of the barbell 4. The weights comprise equal numbers of weight plates 6*a*, 6*b* at equal distances 7*a*, 7*b* from the end of the barbell bar 5.

The figure shows a pair of spotter arms 10 comprising a right spotter arm 12 and a left spotter arm 14 with the weightlifter 2 pinned under a barbell bar 5 but safe from the barbell bar 5 that is prevented from reaching the neck of the weightlifter 2 by the right spotter arm 12 and the left spotter arm 14.

The weight bench 3 that is shown in FIG. 1 depicts a conventional non-professional grade unit that would be typically found in a home, or outside of a commercial gym. Commercial and professional grades and styles of weight benches are more complex and structurally more robust in appearance.

As viewed by the weightlifter 2 on the weight bench 3 of FIG. 1, the right spotter arm 12 is rigidly coupled to or positioned to be in a fixed relation with a vertical support referred to as a right vertical support 18 on the right side of the weight bench 3. The left side of the weight bench 3 is rigidly coupled to or positioned to be in a fixed relation with a vertical support referred to as a left vertical support 20 on the left side of the weight bench. The weight bench is positioned between the right and left vertical supports 18, 20.

Figure 9:
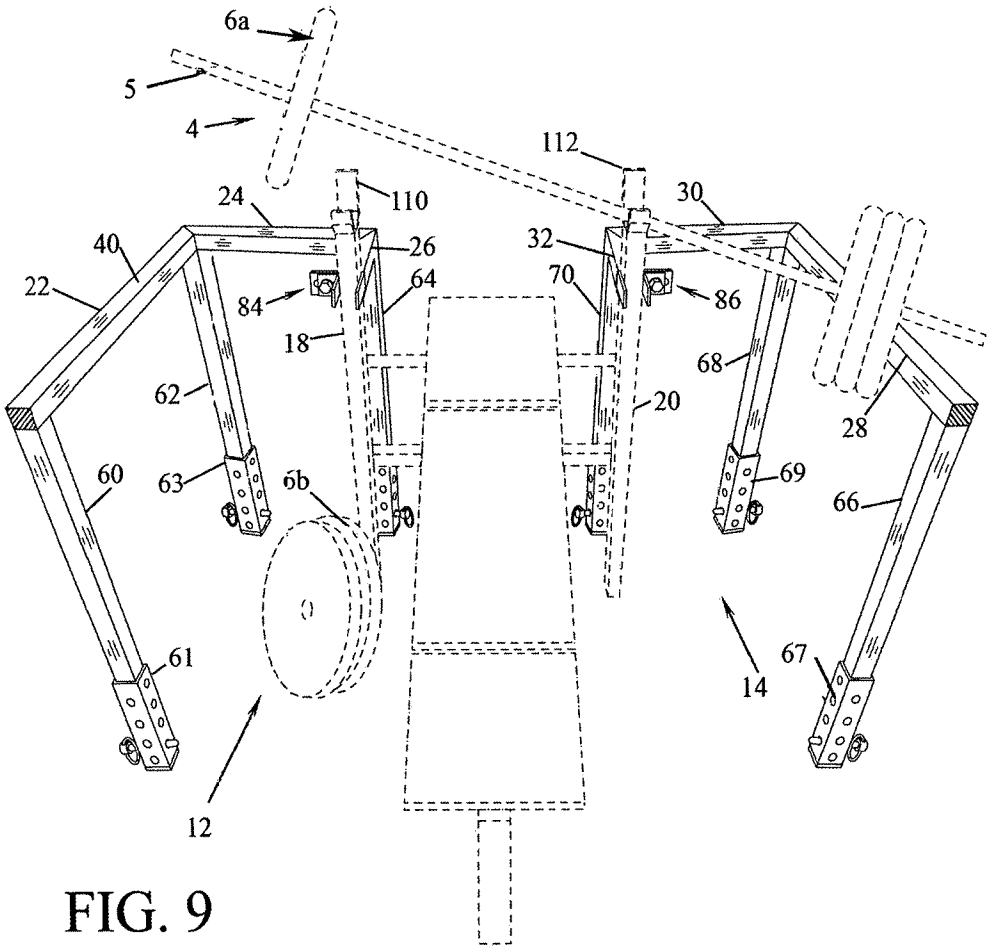
FIG. 9 is a schematic front elevated perspective view of spotter arms coupled to a weight bench, the right spotter arm safety arm stopping the fall of a tilted barbell; the weight bench and barbell being shown in broken lines.

The weight bench 3, barbell 4 and goal posts 18, 20 are shown in FIG. 1 and also in FIG. 9 and in broken lines to assist the reader in depicting the pair of spotter arms 10 in use.

FIG. 1 schematically shows the right spotter arm 12 and the left spotter arm 14 supporting the ends of the barbell bar 5 and preventing its further decent. By stopping the movement or decent of the barbell bar 5 above the throat, the chest or the face of the weightlifter 2, the pair of spotter arms 10 have intervened, as shown, to stop death or injury to the weightlifter.

Figure 2:
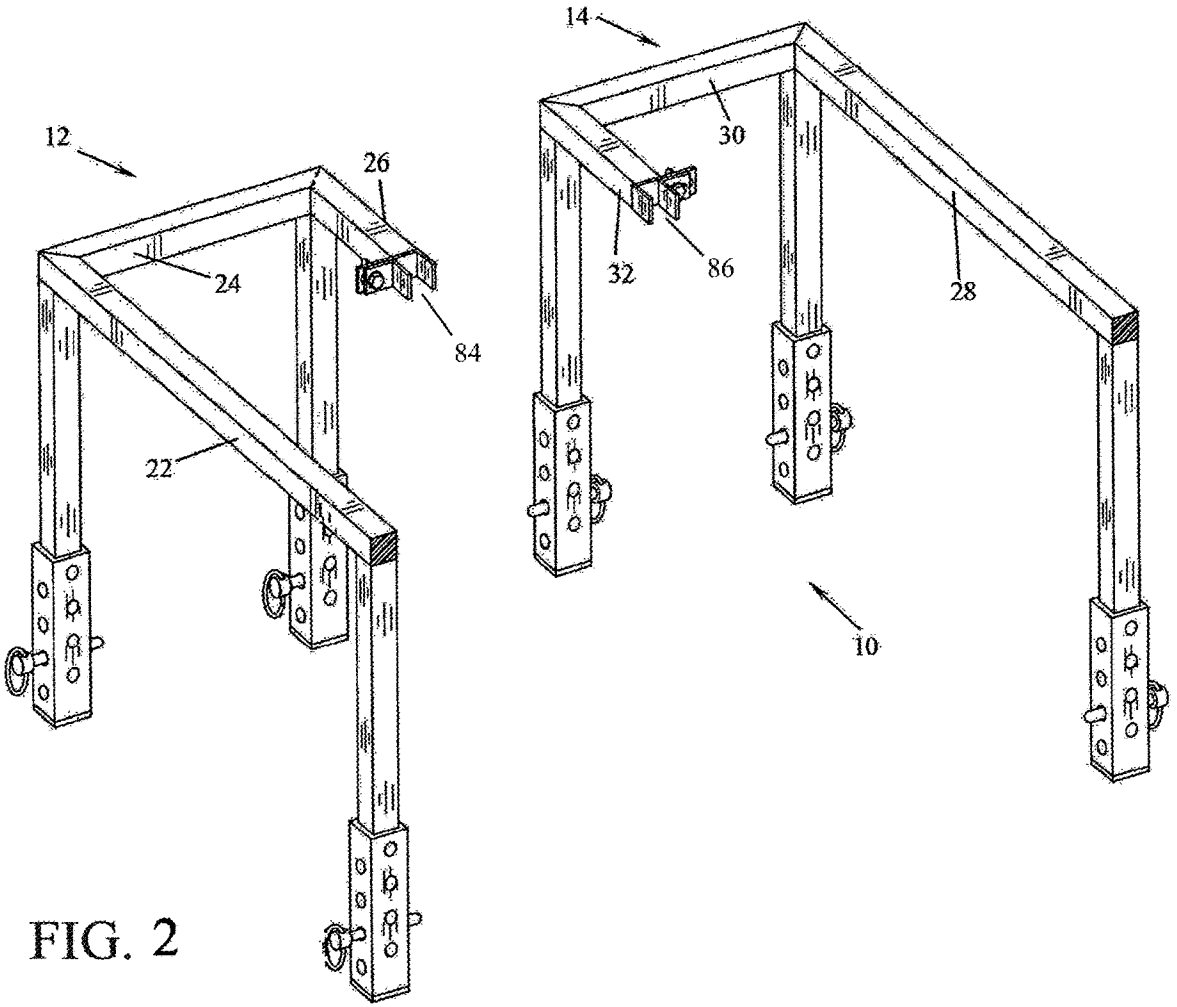
FIG. 2 is a schematic perspective view, from the weightlifter's right side of a pair of spotter arms.

FIG. 2 provides is elevated right front perspective view of the pair of spotter arms 10 showing the right spotter arm (a bench) 12 and the left spotter arm (a bench) 14 not coupled to a pair of vertical supports as was shown in FIG.

Figure 3:
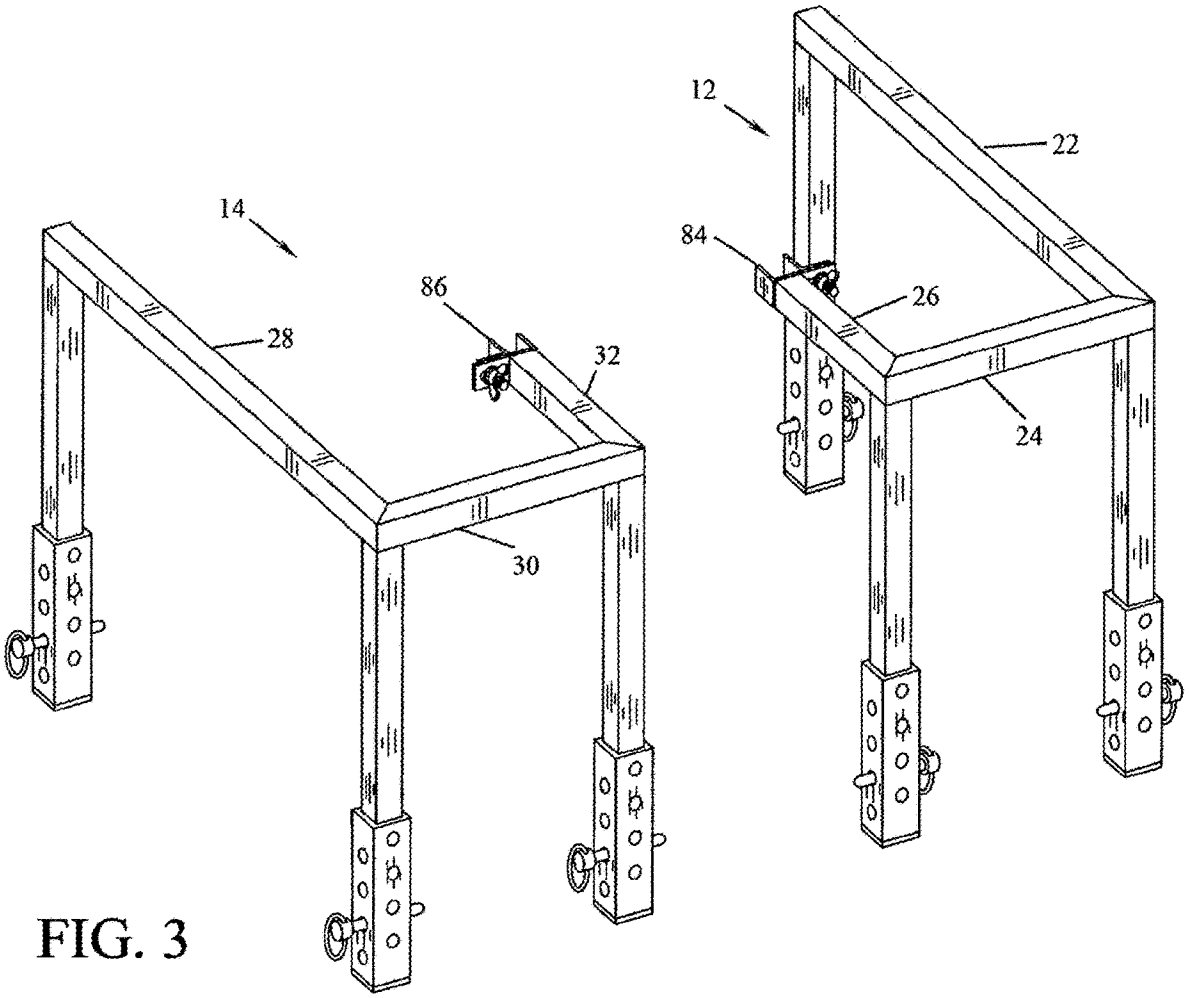
FIG. 3 is a schematic perspective view, from the weightlifter's left side of a pair of spotter arms.

FIG. 3 is an elevated left rear perspective view of the claimed pair of spotter arms 10, and is also without the pair of vertical supports 18, 20 C.

Figure 4:
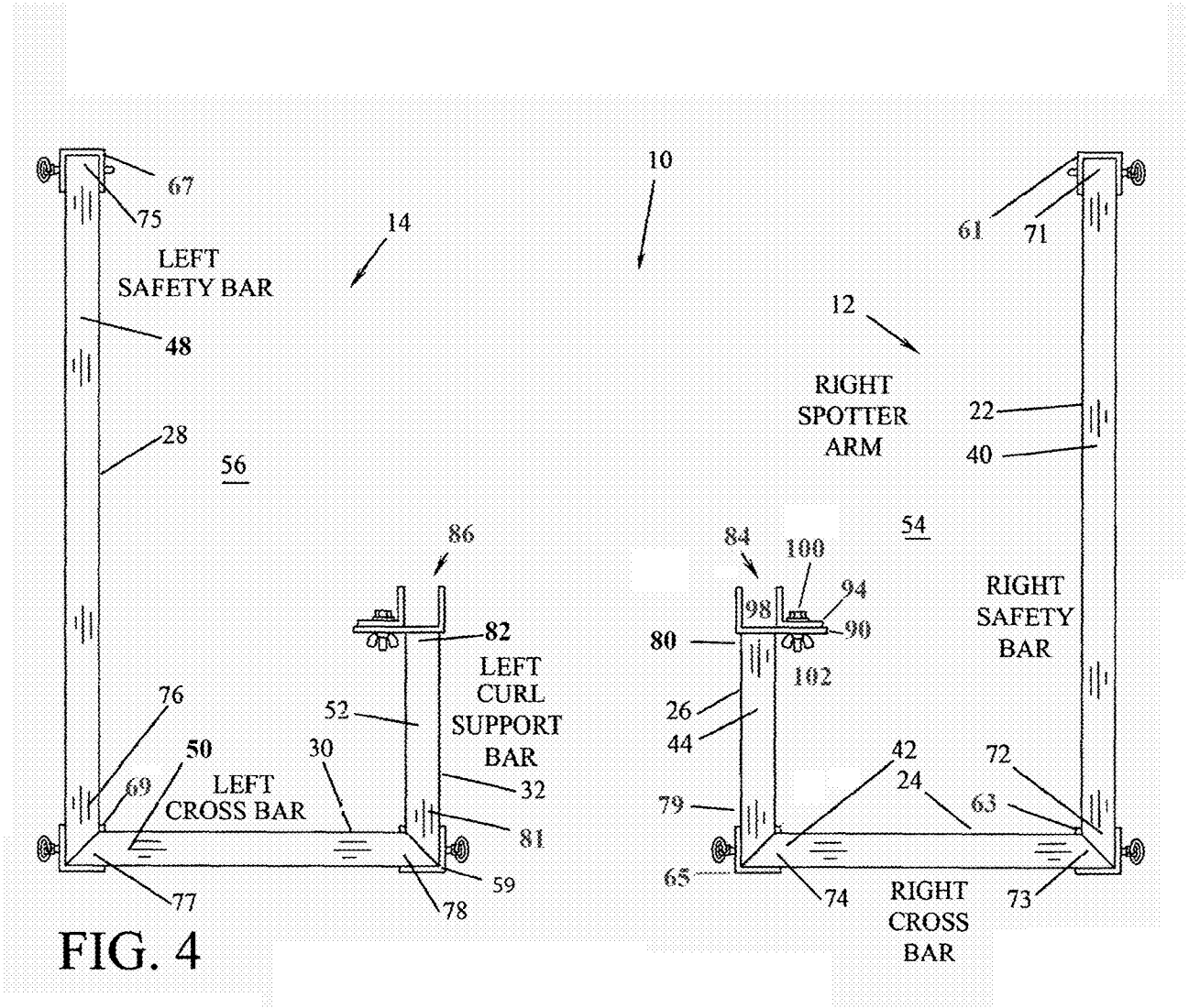
FIG. 4 is a schematic top plan view of a pair of spotter arms.

FIGS. 2, 3 and 4 show that the left spotter arm is a mirror image of the right spotter arm 14. The elements on the right spotter arm include the right safety bar 22, the right cross bar 24 and the right curl support bar 26. The figures show that in each case the bars that form the right spotter arm are identical in size and function to those shown that form the left spotter arm. The left spotter arm includes the left safety bar 28, the left cross bar 30 and the left curl support bar 34.

FIG. 4 shows that the left safety bar 28, the left cross bar 32 and the left curl support bar 34 on the left spotter arm 14 are the same as the right safety bar 22, right cross bar 24 and right curl support bar 26 on the right spotter arm 12 and are serving the same function on left spotter arm lending support to the fact that the right spotter arm and the left spotter arm are mirrored structures. The left curl support bar 34 can also be seen as being a mirrored structure by the fact that it is identical in size, function and relative location as on the same elements on the right, only in a reverse order of position.

As shown in FIG. 2, FIG. 3, FIG. 4 and FIG. 5 The right spotter arm 12 safety bar 22 has a top surface, 40. The right cross bar 24 has a top surface 42, and the right curl support bar has a top surface 44. The right spotter arm safety bar top surface 40, the right cross bar top surface 42, and the right curl support bar top surface 44 are positioned so as to form a right spotter arm (bench) top surface, safety or common plane 54. The left spotter arm safety bar top surface, 48, the left cross bar top surface 50, and the left curl support bar top surface 52 surface are positioned so as to form a left spotter arm (bench) top surface, safety or common plane 56. The length of the legs is adjusted to level the respective top surface, safety or common planes.

The right safety bar 22, the right cross bar 24 and the right curl support bar 26 are rigidly coupled in a clockwise sequence of right angles. The left safety bar 28, the left cross bar 30 and the left curl support bar 34 are rigidly coupled in a counter-clockwise sequence of right angles and support the view that the spotter benches are mirror images of each other.

The right safety bar 22, the right cross bar 24 and the right curl support bar 26 are coupled to position the right safety bar 22 and the curl support bar 26 to be in a parallel relation separated by the length of the right cross bar 24. The left safety bar 28, the left cross bar 30 and the left curl support bar 32 are coupled to position the left safety bar 28 and the left curl support bar 32 to be in a parallel relation separated by the length of the left cross bar 30.

FIGS. 1, 2, 3, 5, 6, 8, 9 and 10 each show that the right spotter arm 12 has a first leg 60, a second leg 62, and a third leg 64 and the left spotter arm has a first leg 66, a second leg 68, and a third leg 70. The right spotter arm first, second and third legs provide load bearing support for the right spotter arm 12, and the left spotter arm first, second and third legs provide load bearing support for the left spotter arm 14. The right and left spotter arms function as right and left spotter arm benches with the spotter arms safety bars being positively located and held to provide positioned spotter arm safety bar protection, and with each bench having its respective three points of support for stability and support above the floor, while being coupled to a respective vertical support 18, 20 for protection against lateral movement.

The right safety bar has a first end 71, and a second end 72. The right cross bar has a first end 73 and a second end 74. The left safety bar has a first end 75, and a second end 76. The left cross bar has a first end 77 and a second end 78.

The right curl support bar 26 has a first end 79 and a second end 80. The second end 80 is an opposing end with a U-clamp 84, 86. The left curl support bar 32 has a first end 81 and a second end 82. The second ends 80, 82 are opposing end with U-clamps 84, 86. The second end of a curl support bar 26, 32 is opposite the first end 79, 81 which is an end that is supported by the third leg 64, 70. The U-clamps 84, 86 represent a means for coupling the respective opposing end to the respective right and left vertical supports 18, 20.

FIG. 4 shows U-clamp 84, 86 at the second end of the right curl support bar 26, and U-clamp 86 or fixture at the second end of the left curl support bar 32. The U-Clamp 86 at the end of left curl support arm 32 is a mirrored image of the U-clamp 84 that appears at the end of the left spotter arm curl support bar 26. The U-clamps shown in FIG. 4 provide an embodiment of a proposed means for coupling the opposing end to the right vertical support 18 and the left vertical support 20. At this time, the use of the U-clamp is believed to be the best mode for practicing the invention. Alternate means include bolting, riveting, welding and bonding with structural adhesive.

In the preferred alternative embodiment, of FIG. 4, each adjustable clamp has a gap or "U-shaped" entry that can receive the respective vertical support 18, 20. The "U-shaped" entry is adjusted to seize its respective vertical support. After adjustment, the U-shaped entry grips the respective vertical support and clamps on the walls of the vertical support to prevent lateral or longitudinal movement of the spotter arm with respect to the vertical support to which it is clamped. The clamps are permanently coupled to the second end 80, 82 of the respective curl support bars 26, 32 by screws, bolts, structural adhesive or welding.

Each of the spotter arms 12, 14 function as a three legged bench having a bench top surface 54, 56 formed by the right safety bar top surface 40, the left safety bar top surface 48, a right cross bar top surface 42, a left cross bar top surface 50, a right curl support bar top surface 44 and a left curl support bar top surface 52. FIG. 4 shows each of the bars as welded to each other in sequence to form a right channel 54 and a left channel 56. Each channel is bordered by the parallel combination of the safety bar and the curl support bar. The width of each channel is limited by the length of the shortest barbell bar that the weightlifter expects to use with the pair of spotter arms.

Figure 7:
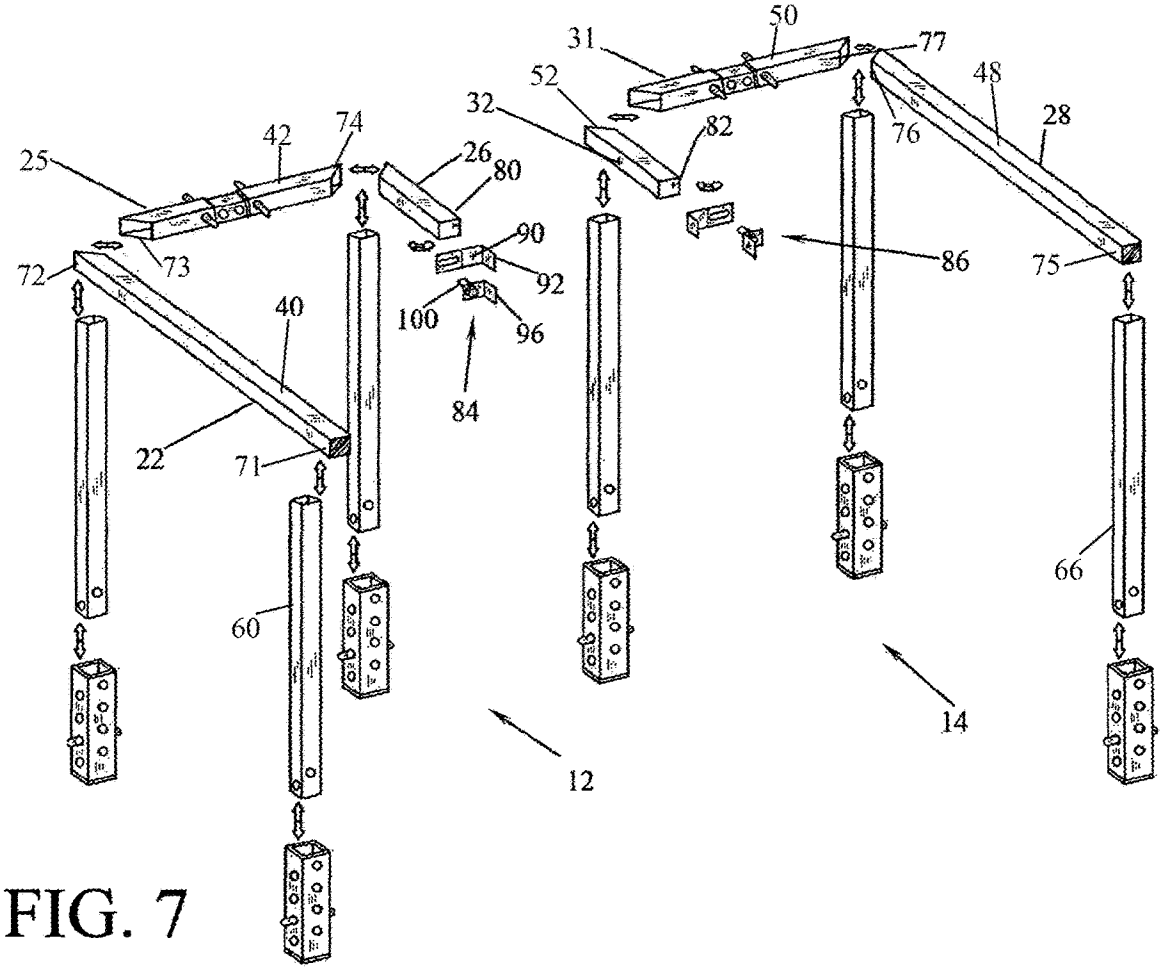
FIG. 7 is a schematic front right side, from the weightlifter viewpoint, elevated exploded perspective view of a pair of spotter arms showing insertion paths for displaced parts, and showing an extendable or adjustable cross-bar.
Figure 8:
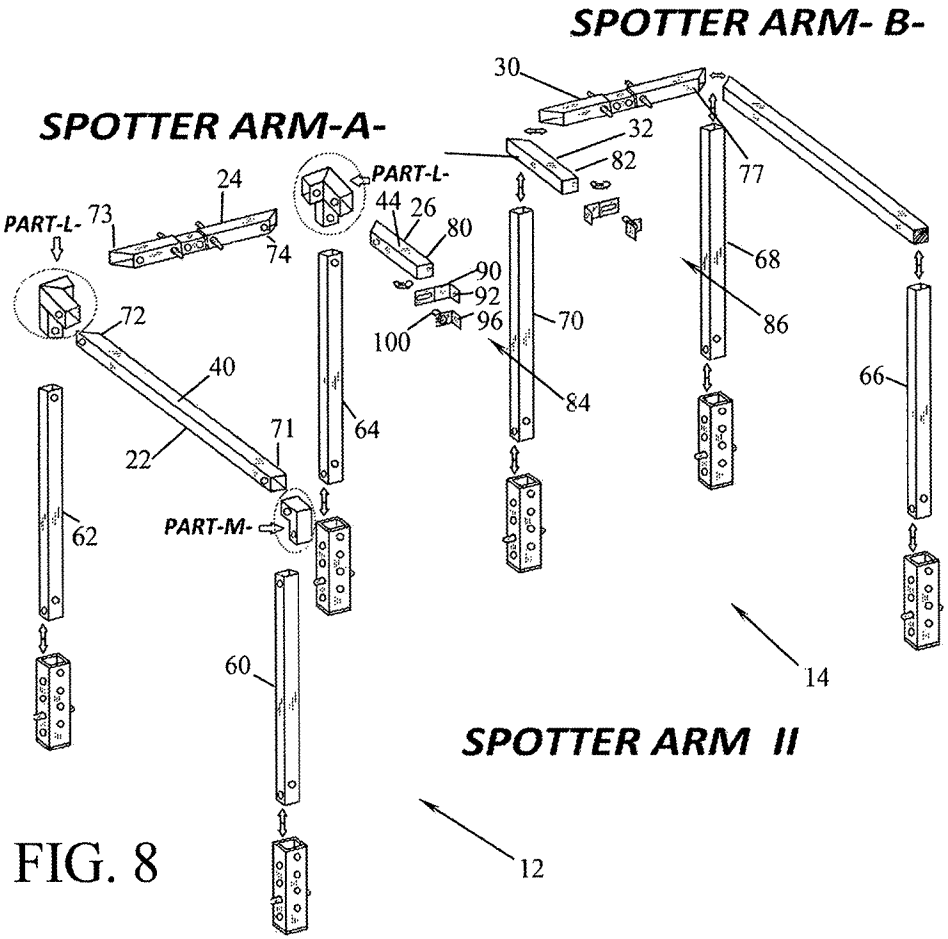
FIG. 8 is a schematic front right side, from the weightlifter viewpoint, elevated exploded perspective view of a pair of spotter arms showing insertion paths for displaced parts, and showing an extendable cross-bar, and also showing sleeve couplings within an ellipse for joining the legs and arms of the right spotter arm as an alternative to welding.

Means for Coupling Opposing End of Curl Support Bar to Vertical Support; U-Clamp Fabrication FIG. 4 provides a top view of an embodiment of a right U-clamp, 84 at the opposing end of the right curl support bar 26 and of a left U-clamp 86 at the opposing end of a left curl support bar 26. The opposing end of the right curl support bar 26 is at the right curl support bar second end 80, and the opposing end of the left curl support bar 32 is at the left curl support bar second end 82. The means for coupling the opposing end of the right curl support bar second end 80 to the right vertical support 18 is represented by the right U-Clamp 84. An example of a means for coupling the opposing end to the right vertical support is shown in FIGS. 1,5, 9, and 10 where the right U-clamp 84 and the left U-clamp 86 grip respective vertical supports 18, 20. Front and back views of the U-clamps 84, 86 are shown in perspective views FIGS. 2 and 5 while FIG. 4 shows a right and left U-clamp from a top view. Exploded views of the right U-clamp 84 and left U-clamp 86 are shown in FIGS. 6, 7 and 8.

Figure 6:
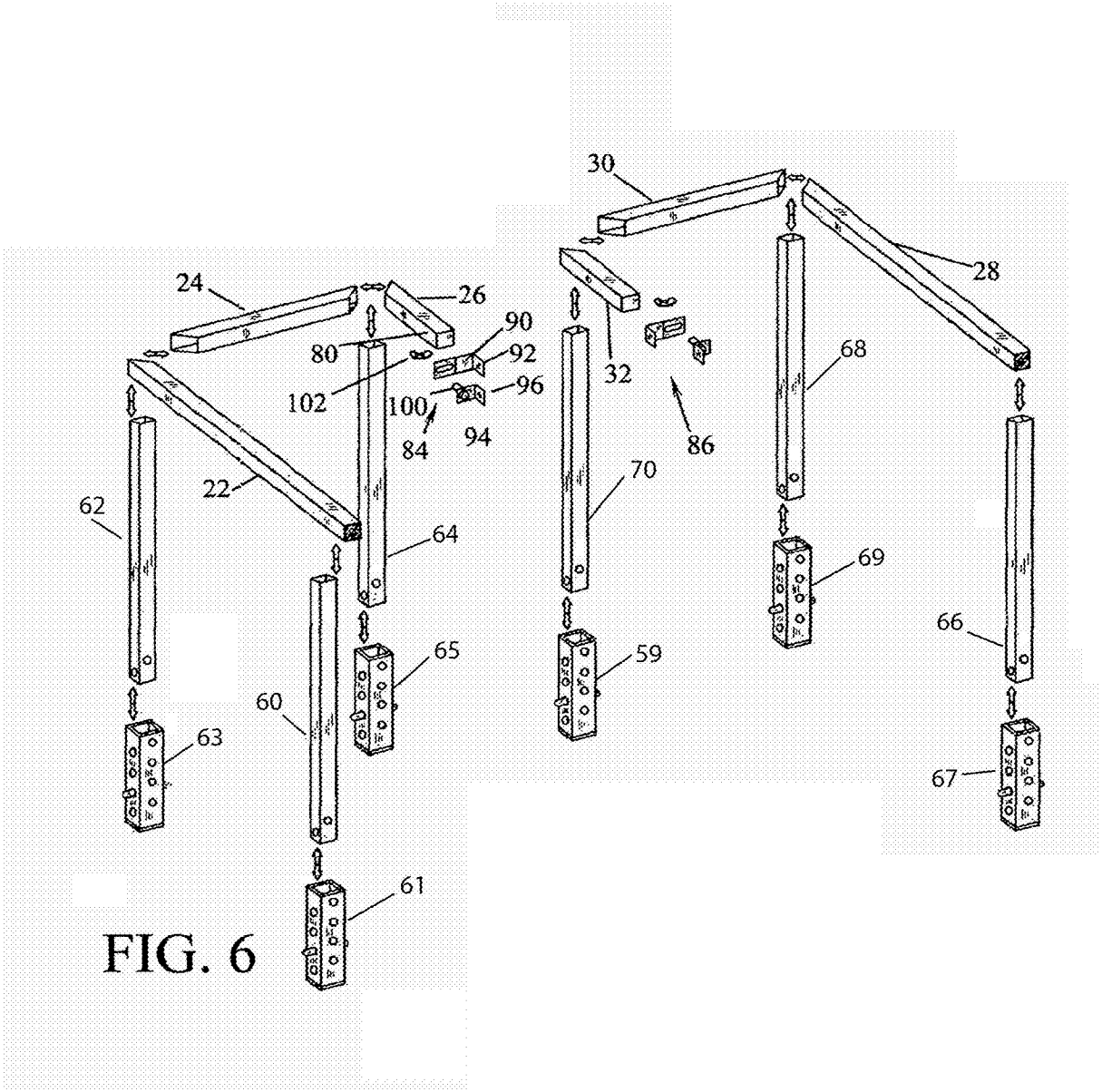
FIG. 6 is a schematic front right side, from the weightlifter viewpoint, elevated exploded perspective view of FIG. 5 of a pair of spotter arms showing insertion paths for displaced parts and showing a cross-bar having a fixed length.

Referring now to FIG. 6, the assembly of the right U-clamp 84 begins at the second end 80 of the right curl support bar 26 with the formation of a right first base plate 90. on the end of the right curl support bar 26. The flat surface at the end of the curl support bar is orthogonal to the central axis of curl support bar. The central axis extends from the right curl support bar first end 79 to the second end 80, the central axis passing though the center of the bar. The several figures referenced show a right first base plate welded to the flat surface. A right first base plate has a right first U-clamp flange 92 formed to extend at a right angle away from the right first base plate 90. The right first U-clamp flange 92 is formed by bending an extension of the plate 90 to form a right angle in the direction of the vertical support 18, A right second plate 94 is formed with a right second U-clamp flange 96 that also extends at a right angle in the direction of the vertical support 18. Referring again to FIG. 6, the right second U-clamp flange 96 is formed by bending an extension of the right second plate to form a right angle in the direction of the vertical support 18

As shown in FIG. 4, and FIG. 6 the right second plate 94 is coupled to, and in contact with, the right first plate 90. The right second U-clamp flange 96 is formed to extend in the direction away from the right second base plate as the right second plate 94 is positioned on the right first base plate 90. The flange of the first plate and the flange of the second plate form a right U-Clamp channel 98 that receives and grips the right vertical support 18. A bolt 100 and wing nut 102 appear in FIG. 4 and FIG. 6 as a means for holding the second plate to the first plate. The bolt has a threaded shaft 100, and a bolt head 101. FIG. 4 shows a wing nut 102 at the end of the threaded bolt shaft 100. The wing nut is free to rotate on the threaded bolt shaft 100 and close the gap between the wing nut and the bolt head with the first and second plates there between.

The second plate 90 has a slot with a channel wide enough to pass the threaded bolt shaft and long enough to allow the second plate 94 to slide into contact with the vertical shaft 18. The first plate has a hole with a hole diameter sized to pass the threaded bolt shaft 100. The threaded bolt shaft 100 is passed through the slot, and the hole and the wing nut are tightened to ease the second plate 94 against the first plate 90 with the first plate flange 92 and the right second U-clamp flange 96 positioned in parallel to form a channel 98 for accepting the right vertical support 18.

Cross Bar Length

The top plan view of FIG. 4 shows that the length of the cross bar 24 establishes the separation in parallel relation of the right safety bar 22 from its right curl support bar 26. Each leg 60, 62, 64, 66, 68, 70 supporting the right and the left spotter arms 12, 14 spotter benches has its means for adjusting its length. FIG. 4 shows that the right curl support bar 26 has an opposing end at its second end 84 that is an end that is opposite the end that is supported by the third leg 64. The curl support bar opposing end has a means for coupling the opposing end to the right vertical support 18. The means for coupling shown in FIG. 4 and FIG. 5 is a U-clamp 84.

FIG. 4 provides a top plan view of the pair of spotter arms 10 with a right spotter arm 12 on the right and a left spotter arm 14 on the left. The height above the floor of the right spotter arm (bench or plane) or bench top 54 is determined by adjusting the length of the right spotter arm first, second and third leg 60, 62 and 64. The height above the floor of the left spotter arm (bench or plane) or bench top 56 is determined by adjusting the length of the right spotter arm first, second and third leg 66, 68 and 70.

Means for Adjusting Leg Length

Figure 5:
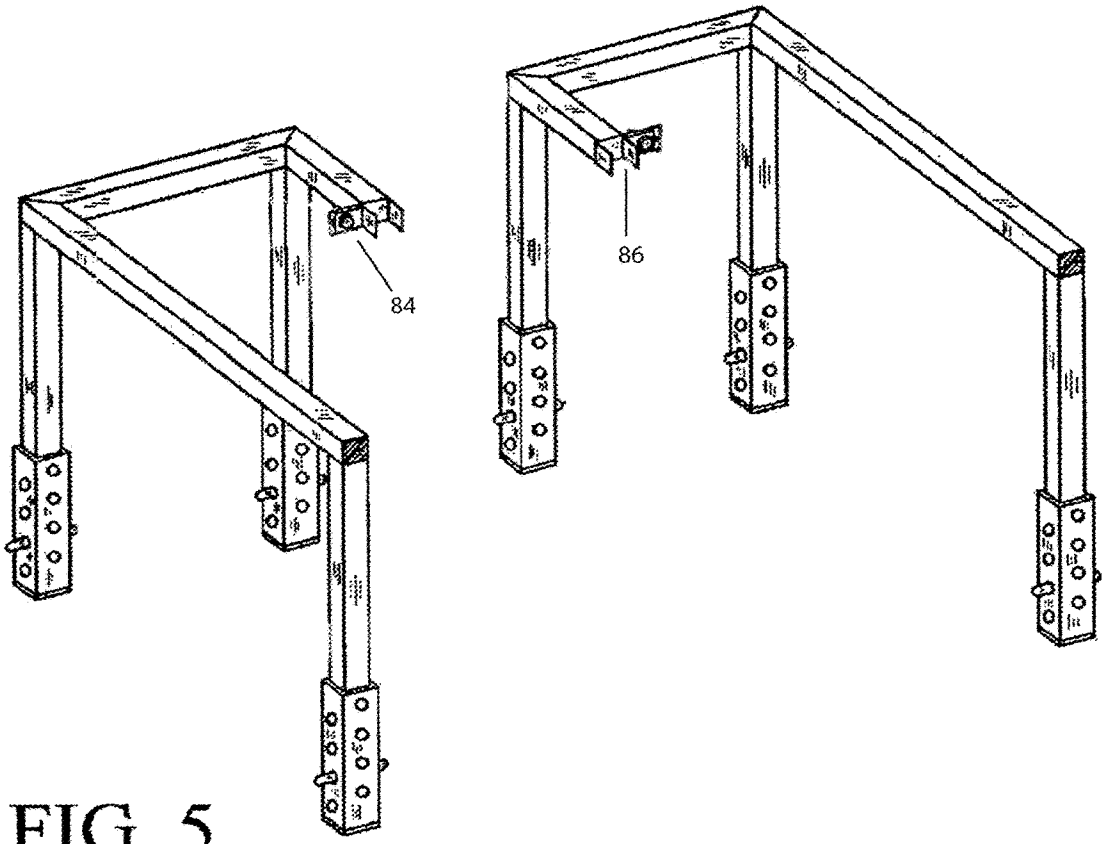
FIG. 5 is a schematic right front, from the weightlifter viewpoint, front perspective view of a pair of spotter arms for a weight bench with legends showing part names.

FIG. 5 provides perspective view of the pair of spotter arms with legends on the components. The length of the legs on the right spotter arm and on the left spotter arm are adjusted to position the common plane of the right spotter arm 54 to be co-planar plane with the common plane of the left spotter arm 56. The height of the co-planar common plane above the floor is adjusted by adjusting the length of the legs of the the right and the left spotter arms 12, 14 60, 62, 64, 66, 68, 70 to position the co-planar planes to [0086] FIGS. 5, 6, 7 and 8 show that each leg has a means for adjusting its respective length to control the height of the spotter arm. Each leg is shown to be formed from a four sided steel shaft or tube with the bottom or lower end of each shaft inserted into a telescoping height adjustment sleeve 61, 63, 65, 67, 69 and 59. A four sided telescoping height adjustment sleeve is shown at the lower end of each leg represents a first embodiment of an adjustment means. Six legs, each having a four sided steel shaft each with a four sided telescoping steel height adjustment sleeve for length adjustment are shown. Six sleeve are shown in the Figures, each adjustment sleeve is telescoped onto the lower end of each of six legs. The outer dimension of the leg material is selected to slide freely within its respective height adjustment sleeve. The legs and sleeves are coated to prevent corrosion. Each leg and each height adjustment sleeve is made to have a vertical array of through holes (at least two in number) typically on one inch centers displace by 1½ inch on adjacent sides to improve height adjustment granularity. As the height of a leg and a sleeve combination is determined, a pair of opposing holes in the steel shaft leg is matched with a pair of opposing pair of holes in the height adjustment sleeve, a pin is pushed through the hole in the height adjustment sleeve and urged to pass through the holes in the steel shaft and then to then pass through the distal holes aligned at the same level in the height adjustment sleeve to lock the length of the leg. The pin passes into a hole on a first side of the height adjustment sleeve, and then passes though the steel shaft forming the leg combination or assembly from a near surface and then exiting on a far surface. The pin is held in shear, thereby locking the vertical position of the sleeve and fixing the final height of the leg. A range of course adjustment is necessary because floors are sometimes not level and also because the height of the spotter arms will have to accommodate the range of height of weight benches in combination with a range of chest sizes of weight lifters, the length of bar bell bars and the height above the floor of the yokes or saddles on top of the vertical supports 18, 20 that are typically found at the upper end of the vertical supports 18, 20. be at a common level above the face and chest of the weightlifter.

FIGS. 5, 6, 7 and 8 show that each leg has a means for adjusting its respective length to control the height of the spotter arm. Each leg is shown to be formed from a four sided steel shaft or tube with the bottom or lower end of each shaft inserted into a telescoping height adjustment sleeve 61, 63, 65, 67, 69 and 59. A four sided telescoping height adjustment sleeve is shown at the lower end of each leg represents a first embodiment of an adjustment means. Six legs, each having a four sided steel shaft each with a four sided telescoping steel height adjustment sleeve for length adjustment are shown. Six sleeve are shown in the Figures, each adjustment sleeve is telescoped onto the lower end of each of six legs. The outer dimension of the leg material is selected to slide freely within its respective height adjustment sleeve. The legs and sleeves are coated to prevent corrosion. Each leg and each height adjustment sleeve is made to have a vertical array of through holes (at least two in number) typically on one inch centers displace by 1½ inch on adjacent sides to improve height adjustment granularity. As the height of a leg and a sleeve combination is determined, a pair of opposing holes in the steel shaft leg is matched with a pair of opposing pair of holes in the height adjustment sleeve, a pin is pushed through the hole in the height adjustment sleeve and urged to pass through the holes in the steel shaft and then to then pass through the distal holes aligned at the same level in the height adjustment sleeve to lock the length of the leg. The pin passes into a hole on a first side of the height adjustment sleeve, and then passes though the steel shaft forming the leg combination or assembly from a near surface and then exiting on a far surface. The pin is held in shear, thereby locking the vertical position of the sleeve and fixing the final height of the leg. A range of course adjustment is necessary because floors are sometimes not level and also because the height of the spotter arms will have to accommodate the range of height of weight benches in combination with a range of chest sizes of weight lifters, the length of bar bell bars and the height above the floor of the yokes or saddles on top of the vertical supports 18, 20 that are typically found at the upper end of the vertical supports 18, 20.

Further granularity for a fine adjustment is obtained by fitting the bottom of each sleeve with a plate, the plate having a threaded hole for receiving a bolt coupled to a foot plate as used to adjust the height of the comers of washing machines during installation.

FIG. 4 shows the position of the safety bars 22, 28, the cross bars 24, 30 sand the curl support bars 36, 32 after each is end welded in sequence to form a channel. The safety bar and the curl support bar are positioned to be in parallel. The length of the cross bar establishes the separation in parallel relation of the safety bar from its curl support bar. The safety bar, the cross bar and the curl support bar are positioned as they are welded to form a right and left spotter arm, bench or common plane. The planes of the right and left spotter arms are then positioned to provide protection for a weightlifter at a safe height above the weightlifter's face with the weightlifter laying on the weight bench 3 with the adjustment of the length of the three legs under each of the right and the left spotter arms 12, 14. The separation of the safety bars is adjusted to be wide enough to capture the end distances 7*a*, 7*b* of the barbell bar 5 with the weights inside of the right and left safety bars 22, 28 thereby stopping downward movement of the bar before contacting the weightlifter. The weightlifter can confirm the height to be correct by laying on the weight bench 3, lifting the bar bell bar 5 from the yokes and lowering it to where it is supported by the right and left safety bars 22, 28 to insure that the travel of the bar bell bar 5 is stopped before contact with his chest, face or head.

Bar Assembly Topology and Sequence

As shown in FIG. 4, the right and left spotter arms 12, 14 each have a safety bar, a cross bar and a curl support bar. The curl support bar has a first end and a second end. The cross bar has a first end and a second end, and the safety bar, has a first and second end.

Using the right spotter arm 12 as an example for assembly, the right cross bar first end 73 is rigidly coupled to the right safety bar second end 72 by welding. The assembly progresses either sequentially or in a single operation using welds to join the ends of the bars. The joining progresses with the right cross bar second end 74 being welded to the right curl support bar first end 71. The bars are held in a jig to form right angles at the joints.

The three bars are positioned to have their top surfaces form a common plane 54. The bars of each spotter bench are joined to form a common plane. length of the legs of each spotter bench are adjusted to position the right spotter bench top surface 54 and left spotter bench top surface 56 into a common safety plane that extends from the right safety bar top surface 40 to the left safety bar top surface 48. The height of the common safety plane is adjusted to be above the chest or face of the weightlifter.

With respect to assembly, each of the couplings are preferably formed by welding. However, in all cases, the term "rigidly coupled" also implies that the coupling is by means of bolting or bonding with structural adhesives, or arc welding and assembly being aided with the use of preformed brackets or sleeves, so as to be separable only with the use of cutting or other cleavage tools. In all cases, rigidly coupled implies that the coupling is by means of welding, bolting or bonding with structural adhesives and brackets, so as to be separable only with the use of cutting or other tools.

Adjustable (Telescoping) Cross Bar (FIG. 7)

The spacing of the safety bars between adjacent spotter arms is adjusted by controlling the length of the cross bar between the safety bar and the curl support bar. The total distance between the two outer safety bars is equal to twice the distance from the U-clamp of one of the spotter arms to the safety bar of the same spotter arm, plus the distance between the two U-clamps. The total distance between the two outer safety bars must be less than the length of the shortest barbell bar minus an added safety factor that is acceptable to the owner of the spotter arms and the weight bench and the weightlifter.

With those limits established, a right spotter arm safety bar is moved into a parallel relation with a left spotter arm safety bar by first calculating the maximum length of cross bar that can be used with each of the spotter arms. The length of the shortest barbell bar to be used must be known.

FIG. 7 shows an alternative embodiment in which the right and left spotter arm cross bars are formed with a center solid or sleeve core inserts and with sleeve or solid end portions. The alternative end portions are adjusted and combined to form a cross bar that is adjustable in length. When adjusted for a location and barbell size, the adjustable portions would be fixed with welding, screws, rivets, structural adhesive such as epoxy, or with other fastening means to meet the safety bar separation requirements imposed by the length of the shortest bar bell bar to be used.

FIG. 8 is an exploded view showing a right spotter arm 12 with an adjustable right crossbar 25 and a left spotter arm 14 with an adjustable left cross bar 31. Depending on the barbell bar 5 to be used, it might be possible to obtain the adjustment range needed with only one spotter arm being equipped with an adjustable cross bar 24, 30. As yet another alternative embodiment, the right spotter arm 12, spotter arm A is distinguished from the left spotter arm 14, spotter arm B with its illustration of a two axis right angle coupling sleeve 104 and a pair of three axis right angle coupling sleeves 106*a* and 106*b* as a means for assembling the spotter arms with screws, rivets, spot welding or with structural adhesives as an alternative to welding Left spotter arm 14 shows an exploded view of the arms and legs without the presence of sleeve joints.

FIG. 9 is a front perspective view of an accident scene in which a weight plate has come off one side of a bar bell bar. The imbalance has resulted in the barbell bar 5 lifting off of the right yoke 110, with the bar remaining supported by left yoke 112 as the left side of the bar 5 slides forward but is stopped by the left safety bar 28 which also stops added plates from sliding off of the bar onto the floor.

Figure 10:
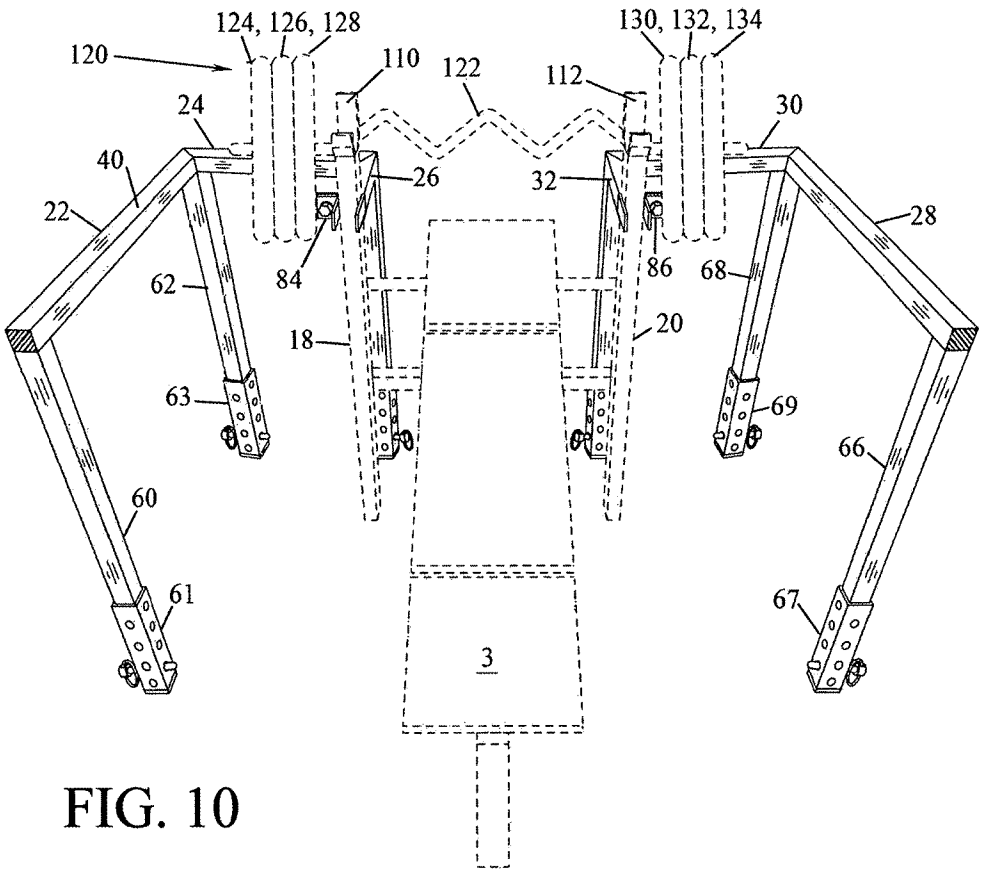
FIG. 10 is a schematic front elevated perspective view of spotter arms coupled to a weight bench, a curl barbell is shown resting on the curl support bar with the curl barbell, goal posts and the weight bench being shown in broken lines.

FIG. 10 shows a curl barbell 120 that is resting on the left and right curl support bars 26, 32 behind the right and left vertical supports 18, 20. Note that the curl barbell bar 122 is not in the right and left yokes 110. 112 at the top of the right and left vertical supports 18, 20. The curl barbell 120 is shown with a total of six weight plates comprising plates 124, 126, 128 on the weightlifter right side position and with weight plates 130, 132, 134 on the weightlifter's left side position, a platform being formed by the right and left curl support bars 26, 32 supporting the weight of the curl barbell bar 122. The purpose of the curl support bars, as shown, is to allow a weightlifter (not shown) to stand behind the left and right spotter arms 12, 14 and, without bending over, to extend his arms outward from his hips in preparation to performing a curl exercise with his palms upward, and grip the curl barbell bar for the beginning or end of a set of repetitions without having to bend over at the waist. The height of the curl support bars 26, 32 above the floor is therefore adjusted to have them at the height of the weightlifter's hips. The right curl support bars 26, 32 add needed stability to the right and left spotter arms or benches and also add a feature that allows the weightlifter to perform a curl exercise without the need to bend at the waist thereby relieving the weightlifter of back strain.

It should be understood that the following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be understood by those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

APPENDIX

List Reference Numbers and Parts 07 03 16

List Reference Numbers and Parts 07 03 16

WEIGHTLIFTER 2
WEIGHT BENCH 3
BARBELL 4
BARBELL BAR 5
WEIGHT PLATES 6*a*,6*b*
END DISTANCES 7*a*, 7*b*
pair of spotter arms 10
right spotter arm 12
a left spotter arm 14,
a right vertical support 18
a left vertical support 20
right safety bar 22
right cross bar 24
adjustable right cross bar 25
right curl support bar 26
left safety bar 28
left cross bar 30
adjustable left cross bar 31
left curl support bar 32
right safety bar top surface 40
right cross bar top surface 42
right curl support bar top surface 44
left safety bar top surface 48
left cross bar top surface 50
left curl support bar top surface 52
right spotter arm (bench or plane) 54
left spotter arm (bench or plane) 56
the right spotter arm first leg 60
telescoping height
adjustment sleeve 59
telescoping height adjustment sleeve 61
telescoping height adjustment sleeve 63
telescoping height adjustment sleeve, 65
telescoping height adjustment sleeve, 67
telescoping height adjustment sleeve, 69
the right spotter arm second leg 62
the right spotter arm third leg 64
the left spotter arm first leg 66
the left spotter arm second leg 68
the left spotter arm third leg 70
the right safety bar first end 71
the right safety bar second end 72
the right cross bar first end 73
the right cross bar second end 74
the left safety bar first end 75
the left safety bar second end 76
left cross bar first end 77
left cross bar second end 78
right curl support bar first end 79
right curl support bar second end 80
left curl support bar first end 81
left curl support bar second end 82
right U-Clamp 84
U-clamps 84,86
left U-Clamp 86
right first base plate 90
a right first U-clamp flange 92
a right second plate 94
a right second U-clamp flange 96
threaded bolt shaft 100
bolt head 101
wing nut 102
two axis right angle coupling sleeve 104
three axis right angle coupling sleeve 106
right vertical support yoke 110
left vertical support yoke 112
curl barbell 120
curl barbell bar 122
right curl weight plates 124, 126, 128
left curl weight plates 130, 132, 134

What is claimed is:

1. A pair of spotter arms for use with
a weight bench, the weight bench being coupled to and between a right vertical support, and a left vertical support, the right and left vertical supports being fixed and spaced apart in parallel relation and in a vertical plane, the pair of spotter arms comprising:
a right spotter arm,
the right spotter arm having
a right safety bar with a first and second end and a top surface,
a right cross bar with a first and second end and a top surface and
a right curl support bar with an first and second end and a top surface and
the right safety bar first end is coupled to a first leg,
an right safety bar second end is coupled at a right angle to the right cross bar first end and to a second leg, and
the right cross bar second end is coupled at a right angle to the right curl support bar first end and to a third leg, and a means for coupling the right curl support bar second end to the right vertical support, the right safety bar being parallel to right curl support bar, each right safety bar, right cross bar and right curl support bar top surface being fixed and held in a horizontal plane by the right spotter arm first, second and third legs, and a left spotter arm, the left spotter arm having a left safety bar with a first and second end and a top surface, a left cross bar with a first and second end and a top surface and a left curl support bar with an first and second end and a top surface, the left safety bar first end is coupled to a first leg, the left safety bar second end is coupled at a right angle to the left cross bar first end and to a second leg, and the left cross bar second end is coupled at a right angle to the left curl support bar first end and to a third leg, a means for coupling the left curl support bar second end to the left vertical support, the right safety bar being parallel to left curl support bar, each left safety bar, left cross bar and left curl support bar top surface being fixed and held in a left horizontal plane by the left spotter arm first second and third legs, the first, second and third legs of the right and left spotter arms being positioned to align the right curl support bar and the left curl support bar to be in parallel relation to provide a channel between the right curl support bar and the left curl support bar.

2. The pair of spotter arms apparatus of claim 1 wherein: the length of the legs supporting the right spotter arm first, second and third legs and the length of the legs supporting the left spotter arm first second and third legs are adjusted in length to position the right horizontal plane and the left horizontal plane to be co-planar at a predetermined position above the weight bench.

3. The pair of spotter arms apparatus of claim 1 wherein each of the legs on the left spotter arm and a right spotter arm are made adjustable in height by providing each leg with an adjustable sleeve extension.

4. The pair of spotter arms apparatus of claim 3 wherein the cross bar in each of the spotter arms is adjusted in length to obtain a predetermined distance between the right spotter arm safety bar and the left spotter arm safety bar.

5. The pair of spotter arms apparatus of claim 1 wherein the right spotter arm cross bar and the left spotter arm cross bar are made adjustable in length.

6. The pair of spotter arms apparatus of claim 1 wherein the right spotter arm cross bar and the left spotter arm, safety bar, cross bar and curl support bar are coupled using three axis sleeve fixtures for joining bars and adjustable legs that meet at 90 degree intersections.

7. The pair of spotter arms apparatus of claim 1 wherein the means for coupling the right curl support bar second end to the Right Vertical support is a right U-Clamp, and the means for coupling the left curl support bar second end to the Left Vertical support is a left U-Clamp.

* * * * *